United States Patent [19]

Eickmann

[11] Patent Number: 4,748,895

[45] Date of Patent: Jun. 7, 1988

[54] MULTIPLE STROKE RADIAL PISTON MOTOR WITH RADIALLY EXTENDING GUIDE SEGMENTS ON THE ROTOR AND WITH FOUR ROLLERS CARRIED BY EACH STROKE TRANSFER BODY

[76] Inventor: Karl Eickmann, 2420 Isshiki, Hayama-Machi, Kanagawa-Ken, Japan

[21] Appl. No.: 932,426

[22] Filed: Nov. 19, 1986

Related U.S. Application Data

[60] Division of Ser. No. 429,649, Jan. 29, 1982, Pat. No. 4,685,380, and Ser. No. 601,392, Apr. 17, 1984, Pat. No. 4,624,174, which is a continuation-in-part of Ser. No. 344,110, Jan. 29, 1982, abandoned, said Ser. No. 429,649, is a division of Ser. No. 344,110, Jan. 29, 1982, abandoned, which is a division of Ser. No. 119,349, Feb. 7, 1980, abandoned.

[51] Int. Cl.[4] ..... F01B 13/00

[52] U.S. Cl. ..... 91/197; 91/488; 92/56

[58] Field of Search ..... 91/197, 488, 491; 92/56, 12.1, 147

[56] References Cited

U.S. PATENT DOCUMENTS

| | | | |
|---|---|---|---|
| 496,966 | 5/1893 | Allen | 91/197 |
| 622,318 | 4/1899 | Almond | 91/197 |
| 2,111,659 | 3/1938 | Benedek | 91/497 |
| 2,599,609 | 6/1952 | Carey | 92/58 |
| 3,255,706 | 6/1966 | Eickmann | 91/488 X |
| 3,270,723 | 9/1966 | Maroney | 91/197 X |
| 4,685,380 | 8/1987 | Eickmann | 91/488 |

FOREIGN PATENT DOCUMENTS

| | | | |
|---|---|---|---|
| 99043 | 8/1898 | Fed. Rep. of Germany | 91/197 |
| 819041 | 10/1951 | Fed. Rep. of Germany | 91/491 |
| 2258066 | 6/1974 | Fed. Rep. of Germany | 91/197 |
| 494332 | 5/1954 | Italy | 91/197 |
| 35513 | 12/1970 | Japan | 91/491 |
| 57507 | 5/1977 | Japan | 91/491 |
| 249940 | 12/1969 | U.S.S.R. | 91/488 |

*Primary Examiner*—Carlton R. Croyle
*Assistant Examiner*—Paul F. Neils

[57] ABSTRACT

The former art provides multi-stroke hydrostatic motors, which perform at a single revolution of the rotor multiple inward and outward strokes of the pistons. A high torque was thereby obtained. The invention discovers, that the know multi-stroke motors have still relatively short piston strokes in relation to the diameter of the rotor.

The invention increases the efficiency of multiple stroke motors by the provision of control communications to control the flow of fluid pressure into pockets open to the piston faces and cylinder walls, whereby the torque of the rotor is transferred from the pistons to the cylinder walls by high pressure fluid in the pockets. The invention also provides radial guide extensions to enlarge the stroke of the pistons in a given size and weight of the device combined with the partial movement of the pockets along the guide extensions.

2 Claims, 4 Drawing Sheets

MULTIPLE STROKE RADIAL PISTON MOTOR WITH RADIALLY EXTENDING GUIDE SEGMENTS ON THE ROTOR AND WITH FOUR ROLLERS CARRIED BY EACH STROKE TRANSFER BODY

REFERENCE TO RELATED APPLICATIONS

This is a divisional application of my earlier application Ser. Nos. 06-429,649, filed on Jan. 29, 1982 and 06-601,392, filed on Apr. 17, 1984. Application 06-429,649 was a divisional application of application Ser. No. 344,110, filed on Jan. 29, 1982, now abandoned, and application Ser. No. 06-601,392 was a continuation in part application of application Ser. No. 344,110 which was filed on Jan. 29, 1982, now abandoned. Application Ser. No. 06-344,110 was a divisional application of application Ser. No. 119,349, which was filed on Feb. 07, 1980; now abanonded, whereof benefit is claimed herewith. Application Ser. No. 06-429,649 is now U.S. Pat. No. 4,685,380, issued on Aug. 11, 1987 and application Ser. No. 06-601,392 is now U.S. Pat. No. 4,624,174, issued on Nov. 25, 1986.

BACKGROUND OF THE INVENTION

It is custom to use multi-stroke hydrostatic motors as high-torque motors. Compared to single stroke motors the multi-stroke motors give a higher torque.

After temporary successes and applications the number of multi-stroke motors has now decreased.

The invention therefore inquires deeply into the technology of multi-stroke motors and discovers the reasons why the common multi-stroke motors have lost so many applications.

After the mentioned deep inquiry into the reasons of partial failure, the invention discloses novel means, which increase the power and efficiency of multi-stroke motors or pumps so drastically, that the novel motors are now capable of higher power per size and weight and at the same time are capable of working with a higher overall efficiency.

FIELD OF THE INVENTION

The invention deals in part with fluid motors or pumps, wherein each piston performs at a single revolution of the rotor a plurality of power strokes and reciprocal strokes.

DESCRIPTION OF THE PRIOR ART

The prior art provides a number of multi-stroke motors, but seldom multi-stroke pumps. The multi-stroke device is especially suitable for high torque motors of not too many revolutions per unit of time.

In the former art the rotor has working chambers, commonly radially extending cylinders, wherein pistons reciprocate. The pistons extend outwards of the pistons and carry radially outwards of the rotor roller or other guide members which are rolling along a multi-stroke cam in the housing of the device. The multi-stroke cam is provided with inwardly and outwardly inclined faces, whereat the rollers run and thereby move the pistons inwards in the cylinders or allow them or force them to move outwards in the cylinders.

The inclination of the mentioned inclined faces actuates a tangential or lateral force onto the piston, when the piston is subjected to high pressure fluid in the respective cylinder. In other words, the radially directed force of the high pressure fluid in the cylinder onto the bottom of the respective piston is transformed into a radial and a tangential component of forces by the angle of inclination of the respective guide face of the stroke guide. The mentioned tangential component of force is sometimes also called a lateral force, because when seen in the direction of the axis of the piston, the tangential force acts not in the direction of the axis of the piston but laterally thereto. Seen in the overall structure of the device, the description as tangential force appears to be more proper, because the force acts in the direct direction of the torque, which is a tangential direction relative to the rotor.

The mentioned lateral or tangential component of force on the piston is during the power stroke of the piston transferred in the former art by the outer face of the piston onto the wall of the cylinder and thereby the rotor is revolved and obtains a torque.

SUMMARY OF THE INVENTION

The invention discovers, that very drastic and novel steps must be taken in order to obtain an advancement of the multi-stroke devices. These steps have to be:

First: The stroke of the pistons must be increased per given size in order to increase the power.

Second: Tangential fluid pressure fields must be set between the piston walls and the cylinder walls in order to be able to carry the tangential load.

Third: Means must be found to control the flow of fluid pressure into the fluid pressure pockets at power strokes and to cut the supply of pressure off at the reciprocal strokes.

Fourth: The actuation area of the tangential load transfer onto the piston must be transferred from a location radially outward of the cylinder to a location inwards of a cylinder or along a cylinder wall portion.

Fifth: The inclination angle of the stroke guide faces must be increased for extremely high torque applications, and, sixth: The means to improve the devices must be in balance with each other and complement each other in order that disturbance of one of the features by the other or others is prevented.

The invention now discovers the means, which can materialize the required steps and applies them singly or in most cases in combination. Thereby the invention attempts to obtain the following aims and objects of the invention:

One object of the invention is to provide to pistons in radial piston devices transfer bodies which carry front and and rear rollers to let the rollers run along a multi-curved guide path for guiding the piston strokes of the pistons.

Another object of the invention is to set rollers of transfer bodies in multi stroke radial piston devices laterally of the medial portions of the pistons in order to align them radially with the centers of fluid pressure pockets in the pistons.

A still further object of the invention is to provide effective thrust bodies in a control body in a rotor's hub for securing a good sealing of the control arrangement in the rotor's hub to effectively control the flow of fluid into and out of working chambers in a rotor wherein the control body is applied with at the same time preventing excessive leakage in the device.

Still another embodiment of the invention is to set piston shoes axially endwards of the piston onto a piston crossing pin for the running of slide shoes on the piston stroke guide faces of the piston stroke guide whereby the slide shoes are borne on the mentioned pin and fluid pressure pockets with passages for fluid are provided to the pin and slide shoes in order to secure a durable swing of the respective portions with small friction.

Another object of the invention is to secure an extremely long piston stroke in order to obtain a high efficiency of the device by having a long piston stroke on a guide face of a small diameter.

And further aims and objects of the invention will appear in the description of the preferred embodiments and in the appended claims.

In this specification and in its claims the word "pivotion" defines a "pivotal movement". The term "pivotion" is known in the patent literature from U.S. Pat. No. 4,387,866.

As far as the Figures illustrate embodiments, they show embodiments of the present invention.

DESCRIPTION OF THE PREFERRED EMBODIMENTS

Figure 1:
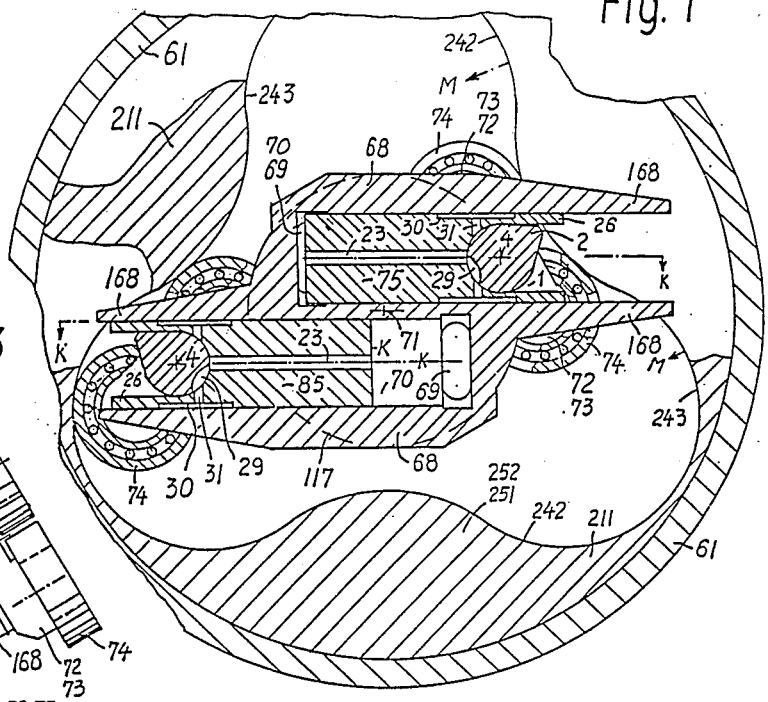
FIG. 1 also shows a longitudinal sectional view through an embodiment.
Figure 2:
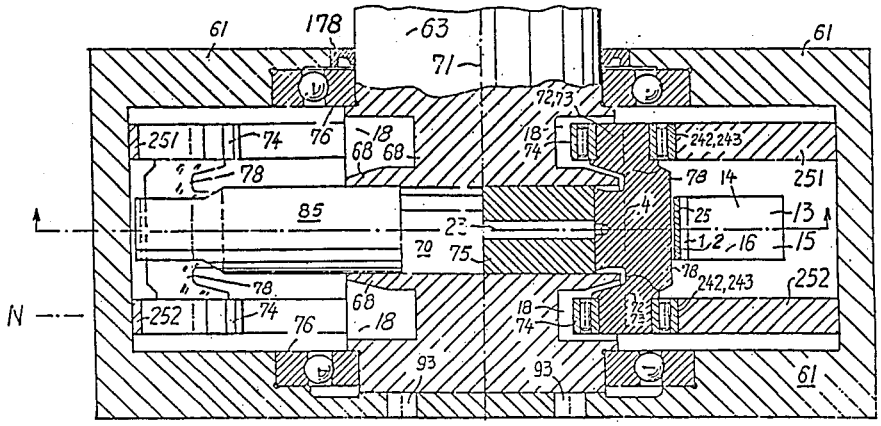
FIG. 2 is a sectional view through FIG. 1 along line K—K.

FIGS. 1 and 2 demonstrate in a housing 61 an embodiment of the invention which illustrates at the same time two different means of the invention. FIG. 2 is a section along line K—K of FIG. 1.

This embodiment illustrates two pistons 75,85 provided in respective cylinders, f.e. 70, of a rotor with each of the pistons individually bearing a stroke transfer body 4 with a neck 2. The neck 2 has here axial extensions 78 and the axial extensions 78 carry distanced from the middle in peripherial direction or in the direction of rotation two pairs of rollers 74. Each pair of rollers 74 has a forward roller and a rear roller on a forward holder 73 and on a rearward holder 72. Since the load is now carried by four rollers instead of by only two rollers, the rollers may now be ball or roller bearings 74. This arrangement of the first embodiment in these two Figures eliminates the requirement of pivot-angle limitation, because the forward and rear rollers 74 define the angle of pivotion when they run along the respective inward or outward guide faces 242 or 243 of the portions 251,252 of the stroke guide 211. The recesses 29 and passages 23,31 for flow control to pockets 30 can be the same as in the embodiments of my parental application, now patent 4,624,174.

In this embodiment of the invention in FIGS. 1 and 2 is the provision of cylinders or chambers 70 spaced away from the medial center 71 of the rotor 68. These chambers 70 extend beyond the middle 71 deeply into the rotor 68 and almost to the opposite diametrical outer face 117 of the rotor. The pistons can thereby do a very long stroke. Rotor 68 has piston guide extensions 168, which extend from the rotor radially outwards from the rotor's outer diameter 117 to partially enter into the space between the stroke guides 251,252 of stroke guide 211.

This is seen by pistons 75 and 85 whereof 75 has an innermost and piston 85 has an outermost location. Channels 69 are the channels for the transfer of fluid into and out of chambers 70. Bearings 76 carry the rotor 68 and a shaft seal 178 may be provided.

The stroke transfer bodies 4 which are borne in beds 1 of the pistons 75 and 85, pivot at the running of the device around their axes 4. The pistons have fingers or extensions 26 which extend radially outwardly beyond the necks 2 of the transfer bodies to be guided on guide faces 13,14 or 15,16 of the stroke guide extensions 168. Holders 25 may be provided between the extensions 26 to prevent escape of the transfer bodies 4 from their beds 1 in pistons 75 or 85. The rotor 68 has radially outwardly open recesses 18 for the temporary reception of the rollers 74 during the radially inner portions of their reciprocation and running along the piston stroke guide faces 242,243. It is easily and directly visible from FIG. 1 that the forward and rearward rollers 74 define the pivotal movement of the transfer bodies in their beds in the pistons. Since FIG. 1 illustrates a device for either clockwise or counterclockwise revolving of the rotor, the front rollers 72 become rear rollers 73 and vice versa at reversal of the rotary direction of the rotor.

Figure 13:
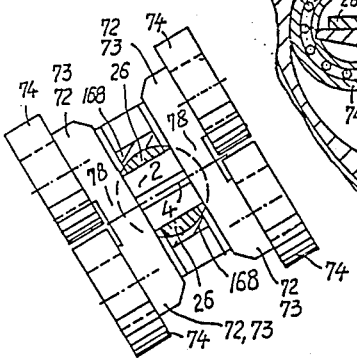
FIG. 13 is a view onto a portion of FIG. 1 along the arrowed line M—M of FIG. 1.

FIG. 13 is a view onto the transfer body 4, its neck 2, its portions 78,72,73 and its rollers 74 seen from the arrowed line M—M of FIG. 1. Since this line crosses portions of the extensions 26 and 168, these portions are seen in sectional views in FIG. 13 and are, respectively, provided with hatching lines.

FIG. 1 is also a cross sectional view through FIG. 2 along the arrowed line in FIG. 2. However, in order to illustrate more clearly the relationship between the rollers 74 and the piston stroke guide faces 242,243 on the piston stroke guide bodies 251,252 of the piston stroke guide 211, the rollers 74 and the piston stroke guide bodies 251,252 are partially and between breaking lines, shown in sectional views with hatching lines along the line "N" of FIG. 2.

Alternatives, other details, features or possibilities of the embodiments of this specification may be found in the earlier mentioned parental U.S. Pat. Nos. 4,624,174 or 4,685,380. FIGS. 3 and 4 illustrate again two other embodiments of the invention. The chambers or cylinders are chambers 70 of FIGS. 1 and 2, which provide the extremely long piston stroke and which are defined thereby that their axes are laterally distanced from the center 71. The arrangement is in FIG. 4 a section along line XI—XI of FIG. 3.

Figure 3:
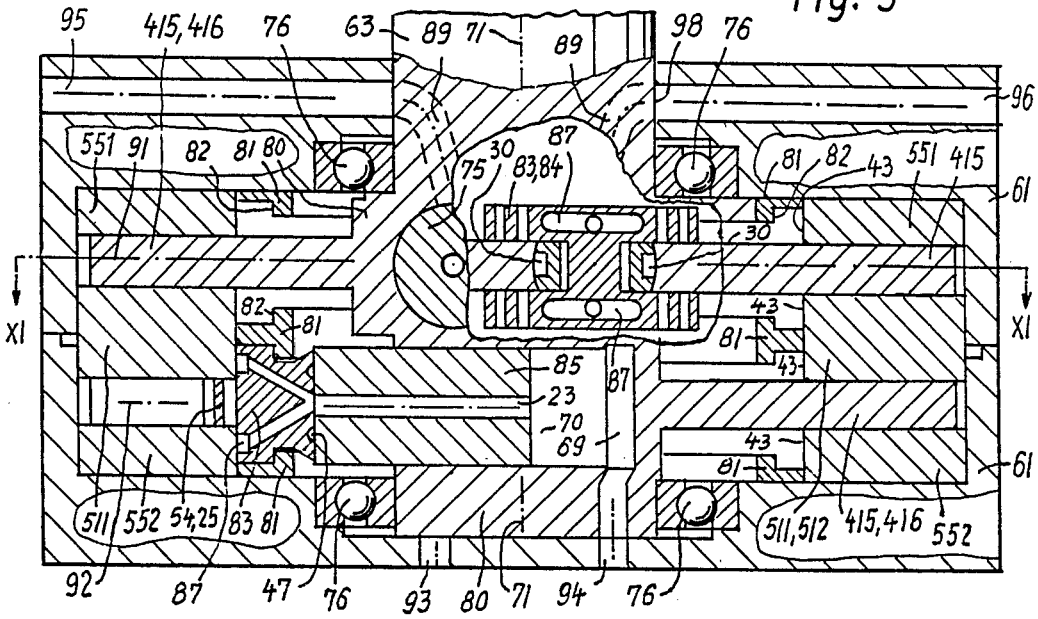
FIG. 3 is a longitudinal sectional view through an embodiment.
Figure 4:
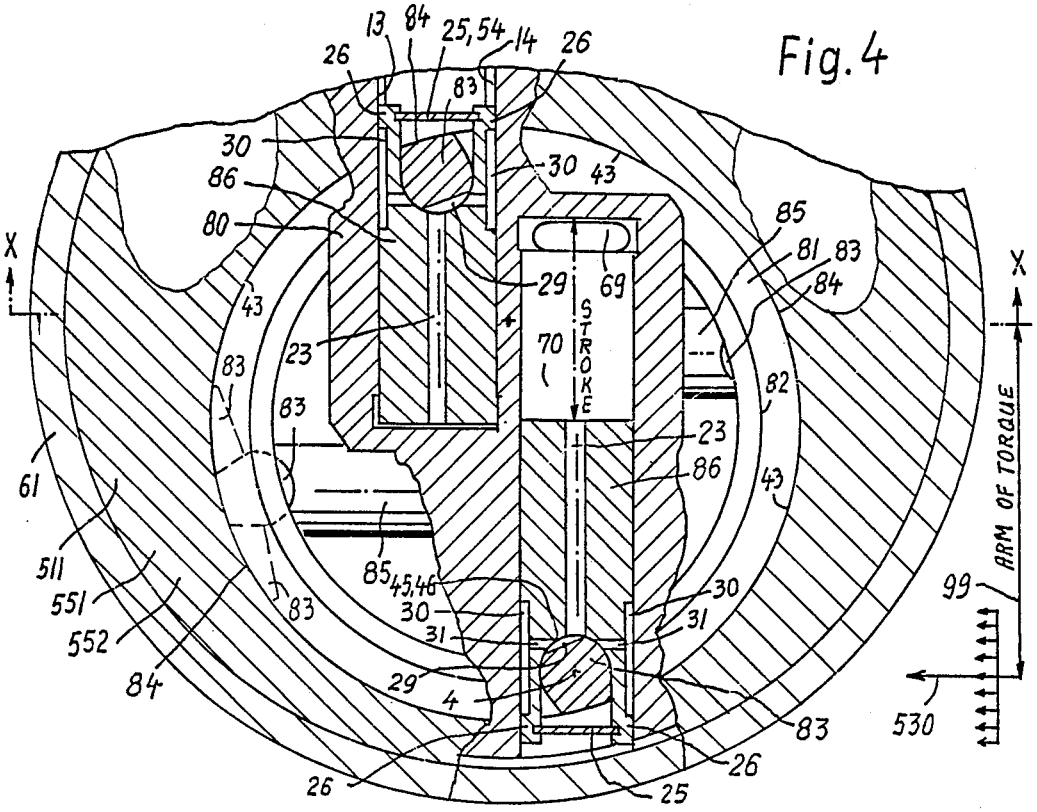
FIG. 4 is a sectional view through FIG. 3 along line XI—XI with the exception, that the section through members 511, 551, 552 runs partially parallel to the line with arrows XI—XI of FIG. 3.

The first embodiment of the these FIGS. 3 and 4 is, that a plurality of chamber groups, which are axially distanced from each other, are provided on the rotor.

The second embodiment of the invention, illustrated in FIGS. 3 and 4 is, that common piston shoes of my elder or co-pending patent or patent applications can be used. The requirement of pivot-angle limitation stoppers is hereby also spared. That is obtained thereby, that the stroke guide has cylindrical inner faces which form the inclined inward and outward guide faces. In this case every piston group has only one inward and one outward stroke at the same revolution, because the multiples of strokes per revolution are obtained by the application of the multiple groups of chambers. The rotor 80 has correspondingly a plurality of radial extensions 415 or 416 and there must be a medial portion 511 with guide faces on the stroke guide arrangement. Since my elder patent-piston shoes can be used in these figures, they can be utilized for self-suctioning of fluid. The device is insofar also suitable as a self-suctioning pump. The traction rings 81 with traction faces 82 are therefore provided, when so desired, to guide the piston shoes 83 outwards by embracing their end portions radially from the inside. Since the outer faces 84 of the piston shoes 83 define the angle of inclination or of pivotion, there is no requirement for pivot-angle limitation faces or stoppers in this embodiment. The required arrangement of the fluid pressure pockets 30 and the control of flow of fluid to them can be applied as in my U.S. Pat. No. 4,374,486. The fluid pressure pockets 87 in the piston shoes are equal to those in my patents, for example as in my U.S. Pat. No. 3,951,047. Novel, however, is the axial shortness of the piston shoes and that is thereby another object of the invention. The piston shoe of this embodiment has the novel feature, that its axial length is about equal to the diameter of the piston whereto it is associated. Thereby the fluid pressure pockets 87 are led radially above the piston and any lateral deformation of the piston shoe's lateral end portions is thereby prevented.

The plurality of chamber groups and piston groups, which are axially distanced from each other in rotor 80, are set with their axes through the radial faces 91 and 92. Channels 69 and 89 demonstrate samples for their location in the rotor and for their control and association to the ports 93,94,95,96. Since the chambers or cylinders extend almost through the rotor 80, the passages or channels are not, as usual in that half of the rotor where the pistons show out of the rotor, but on the diametrically opposite half of the rotor. This must be recognized when setting the controls for the flow of fluid to the chambers 70 and out thereof. Similar matters should be recognized when building the device of FIGS. 1 and 2.

The one chamber group may contain the pistons 85 and the other the pistons 86. FIG. 3 also demonstrates by way of example radial flow control faces or axial flow control faces, namely, the rear end face of rotor 80 and the cylindrical faces 98. In the right portion of FIG. 11 the very long arm 99 of torque which is obtained by the arrangement of the very deep entering-long-stroke pistons 85,86 of FIGS. 1 to 4 and which forms with pressure pocket center 530 the torque-arm 99 multiplied by force 530 of the pocket 30, is also illustrated.

The piston shoes 83 are guided on the guide faces 43. Passages 23,31, pockets 29,30, beds or faces 45,46, axes 4, holders 25,54, outer faces 84, piston portions 26, wall faces 13, and bearings 76 serve to control the operation of the pistons and piston shoes respective to neighboring members. Bearings 76 carry the rotor 80 in the housing 61 and piston stroke actuator—or guide—rings 551,511,552 are located in the housing 61 and form the guide faces 43 to guide thereon the outer faces 84 of the piston shoes 83.

Figure 5:
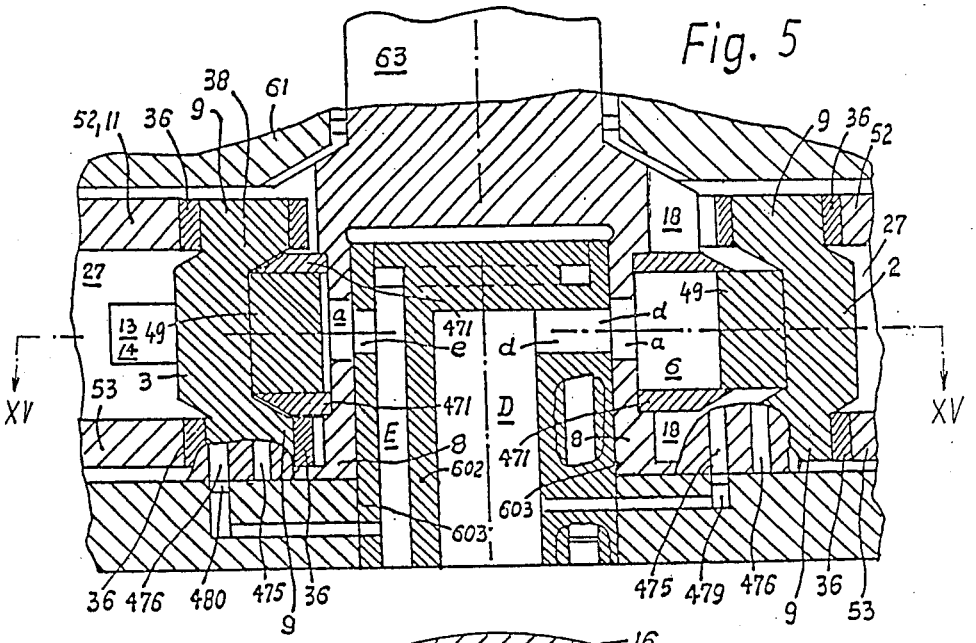
FIG. 5 is a longitudinal sectional view through a further embodiment.
Figure 6:
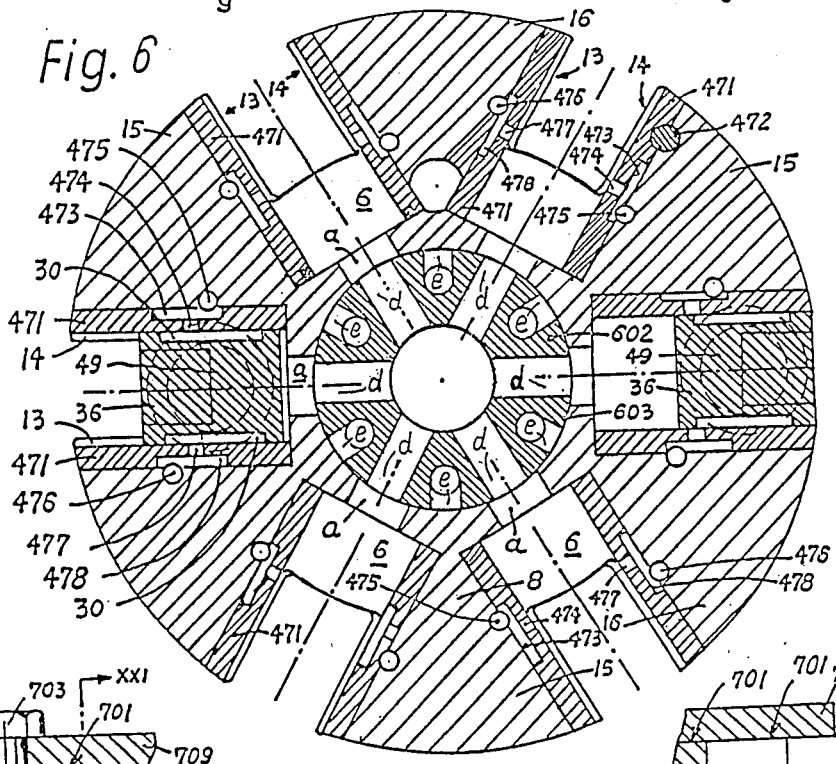
FIG. 6 is a sectional view through FIG. 5 along line XV—XV.

FIGS. 5 and 6 illustrate another embodiment of the invention, which does not require pivotion and pivot-limitation means of the transfer body.

This feature is obtained by setting the transfer of fluid and the control of flow of fluid to the pockets 30 not through the respective pistons but through the rotor. The application of thereby simplified transfer bodies 3 is very convenient. However the application of the flow and flow control through the rotor 8 to the pockets 30 in the pistons 29 requires an additional work and often even the insertion of bushes 471 into the rotor as well as fastening of them by holders 472 to the rotor 8 in order to provide the chambers or cylinders 6 in the bushes. The rotor channels or passages are shown by passages "a". In this embodiment a number of referentials are letters, because the Figures do not provide enough space for the writing of large digits. Control body 602 passes fluid through entrance channel "D" and delivery ports "d" through the channels "a" into the chambers 6 and out thereof through passages or channels "a" and exit ports "e" through exit channel "E". The exits and deliveries are reversed, when the device shall revolve in opposite direction or when it becomes changed from motor to pump or vice versa. The rotor 8,15 or bush 471 has a pair of balance-fluid delivery passages 477 and 474 whereof one extends from the wall face 13 or 14 in the rotary direction and the other in the opposite direction, while they may extend into collection chambers 473 or 478. In any case they communicate to a pair of balance-fluid delivery lines 475 and 476 with one separated delivery line to each separated delivery passage 474 or 477. The delivery lines 475 and 476 port into balance fluid control ports 479 or 480 respectively. The control ports 479 or 480 may be provided on the control body 602 or on a cover or portion of the housing or of the device, depending on actual design and desire. In any case, since the delivery lines 475 and 476 revolve with rotor 8, the control ports 479 and 480 are satationary in order that the lines run over them. When the ports 479 and 480 are laterally, axially or radially distanced from each other, a number of ports 479 and/or 480 may be applied and may also be equal to the number of strokes and guide face sets 43,44. The ports 480 are then communicated to exit channel E and ports 479 to delivery channel "D" or vice versa.

Ports 479 extend over the outwardly inclined guide face 43 areas and ports 480 over the inwardly inclined guide face areas 44 or vice versa. Thereby it is obtained, that at power strokes the respective pocket 30 is communicated to the power channel D or E of higher pressure and the other pocket 30 of the same piston is discommunicated from the power or high-pressure channel D or E. The device of these Figures is an example. The passages, lines, ports etc. can also be set in other places, when suitably designed and machined and when care is taken that they obtain the aim of this object of the invention. The passages 474 and 477 are the extension of the pockets 30 into the walls of the chambers. The fluid pressure pockets could in this embodiment also be completely located in the walls of the chambers 6, but to maintain them in the center of attack of the lateral forces it is better to keep the pockets in the pistons and set the delivery passages 474 and 477 accordingly. The collection chambers 473,478 may facilitate the radial distances of the passages 475,476,474,477 in order that the mentioned passages, ports and like can be easily and straight or under right angles become machined. The passages, lines and collection chambers and other means are provided with referentials at only one chamber 6 because they are similarly provided to the other chambers 6.

Figure 8:
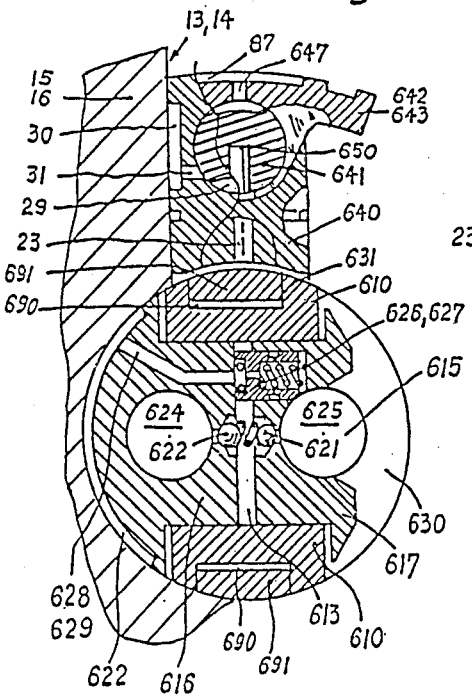
FIG. 8 is a sectional view through FIG. 7 along line XVII—XVII.
Figure 7:
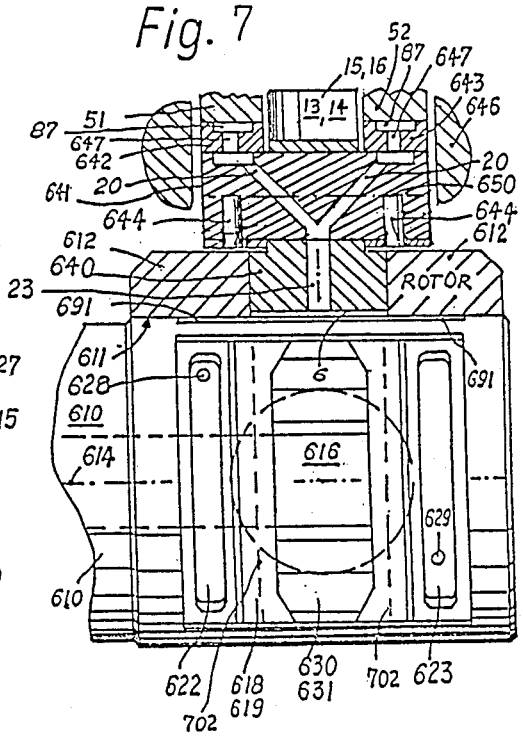
FIG. 7 demonstrates another embodiment of the invention.

FIGS. 7 and 8 illustrate by referential 610 the control body for radial flow, by referential 611 the rotor hub of rotor 612, by referential 613 the space which extends normal to the axis 614 of control body 601 through control body 610 and which contains moveably along the axis 615 of space 613 the thrust members 616 and 617 with their outer faces 618,619 with which they seal along the inner face 611 of the rotor 612. The thrust chamber 613 between the thrust members 616 and 617 is filled with high pressure fluid through one-way valves 621,622 and fluid is passed to the balancing pockets which are shown by referentials 622 and 623 out of respective channels 624,625 over moveable seals 626,627 and passages 628 and 629. The thrust members 616 and 617 also form the control ports 630 and 631. By their thrust against the face 611 of the rotor 612 a tightly sealed flow to and from chambers 6 is obtained without any disturbance of the control- or closing arches 632 and 633 of the control body 610. This embodiment can also be applied in single-stroke devices and not only in multiple stroke devices.

The dotted lines 702 define or indicate the axial ends of the control ports 630,631 by way of example. Control body 610 may be provided with thrust chambers 690 to contain therein seals 691 which are to be pressed by the fluid in chambers 690 against the respective portions of face 611 of rotor 612 for closing and sealing the closing arches between the low- and high-pressure areas of the device.

FIGS. 7 and 8 further illustrate still another embodiment of the invention, namely a slide-shoe arrangement. The piston 640 has a longitudinal first axis extending concentrically in the radially extending passage 23 and a thereto normal second axis 650. Second axis 650 is thereby normal to the longitudinal axis of passage 23 of the piston and also parallel to the axis 614 of the rotor 612 or of the control body 610. A bore without referential number extends around the second axis 650 and the piston 640 carries in said bore the bar 641 which is usually a simple cylindrical bar. The ends of bar 641 extend out of piston 640 and carry on the ends of bar 641 the slide shoes 642 and 643, The slide shoes 642 and 643 are able to slide along the stroke guide end portions 51 and 52. The slide shoes 642,643 have in their radial outer faces the fluid pressure pockets 87 to reduce the load and friction between the slide shoes and the stroke guides 51,52. The stroke guide faces are in this embodiment cylindrical inner faces to permit the simple outer faces of the slide shoes 642,643. Passages 23 and 20,647 are leading fluid under the pressure equal to that in the chamber 6 into the fluid pressure balancing recesses 87. The pressure in pockets 87 is high pressure at power strokes. Guides 646 may be provided in the device to prevent axial or other dislocation of the bar 641 or of slide shoes 642 and 643.

In order to obtain the desired object of the invention, namely to provide additionally active tangential fluid pressure balancing pockets 30 in the pistons, the shoes 642 and 643 are arrested by arresting means 644 to prevent pivotion or excessive pivotion of the slide shoes relatively to the bar 641. The effect thereof is, that under the gradually changing angle of pivotion of the slide shoes 642,643 along stroke guides 51,52, the shoes 642, 643 subject the bar 641 to pivot in unison with the slide shoes 642 and 643. The bars 641 are thereby able to receive a flow control recess 29, whereby the flow of fluid under pressure through the second piston passages 31 into pockets 30 is obtained in timed relation to the pivotion of the slide shoes 642 and 643.

Figure 10:
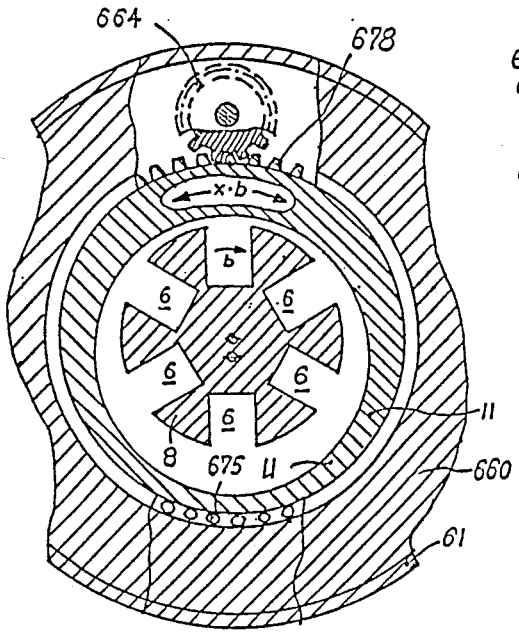
FIG. 10 is a sectional view through FIG. 9 along line XIX—XIX.
Figure 9:
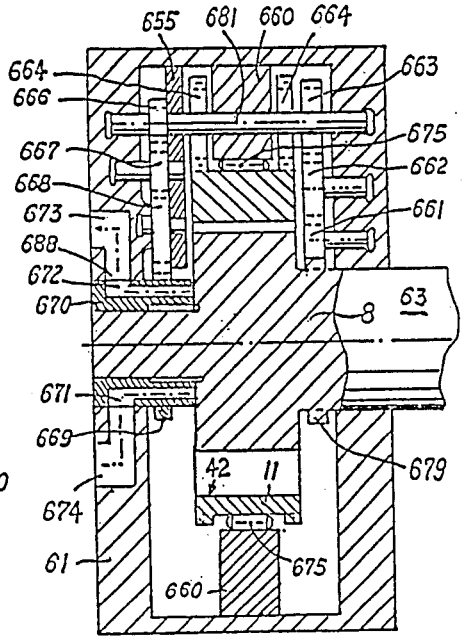
FIG. 9 is a longitudinal sectional view through another embodiment.

The embodiment illustrated in FIGS. 9 and 10 shows a stroke actuator with plural revolutions at each single revolution of the rotor.

Rotor 8 has working chambers 6. Pistons are not shown therein and piston shoes or slide shoes are also not shown, because those already known from the earlier discussed Figures. The stroke guide 11 has a concentric cylindrical outer face which is borne in bearing 675, whereby the stroke guide 11 is borne in bearing 675. Stroke guide 11 has also an eccentric inner face, which forms the guide face 42. It is cylindrical but eccentrically provided relatively to the bearing 675. Gearing means are provided to revolve the stroke guide 11 a plurality of revolutions at each single revolution of the rotor 8. Thereby the multiple strokes are provided and the device is thereby a multi-stroke device. The gearing means may be a matter of design or choice. The Figures, however, show an example of possible gearing means. Shaft 63 or rotor 8 may carry a first gear 679. The first gear 679 may over interim-gears 661,662,663 and shaft 681 drive the second gears 664 to engage the third gears 678 of stroke guide 11 to revolve the stroke guide 11 a plurality of revolutions at each time when the rotor 8 does one single revolution. Supports 660 and/or 668 may carry the bearing 675 or shafts of interim gears. An outgoing second gear 664 may drive another set of medial gears 666,667,668, to drive the fourth gear 669. Fourth gear 669 is attached to the control body 670 with passages 671 and 672 to revolve the control body 670 with suitable revolutions along control ports 673,674 for the control of flow of fluid into and out of chambers 6 in suitable timed relation and angular relation with the rotation of the rotor 8 and the multiple revolutions of stroke guide 11. Each piston assembled in one of the chambers 6 does thereby a plurality of power strokes and directionally opposed non-power strokes at each revolution of the rotor 8 while the torque of the device as well as the flow quantity of fluid therethrough at each revolution of the rotor 8 is multiplied compared to a typical single stroke per revolution device.

Figure 11:
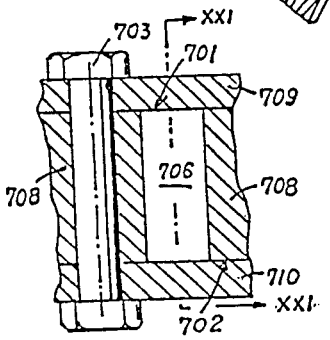
FIG. 11 is a partial section through a further embodiment.
Figure 12:
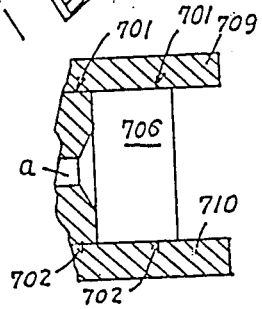
FIG. 12 is a sectional view through FIG. 11 along line XXI—XXI.

The embodiments of FIGS. 11 and 12 illustrate the non-circular, for example rectangular, cross-sectional area through a working chamber 706.

The arrangement makes it possible to use the maximum of space through an axial size of rotor 708. While the cylinder uses only a small place in the neighborhood of the next piston, the rectangular space of the device of these Figures permits a fullest possible utilization of the size of the rotor 708 to obtain a maximum of flow-through quantity of fluid through the rotor of a given size. That increases the torque and power of the device over that of common radial piston machines with cylindrical pistons and working chambers.

The non-circular or rectangular working chambers may be provided radially into the rotor 708 or they may be produced axially through a medial rotor portion 708, whereonto end portions 709,710 may be fastened to plane end faces 701 and 702. The pistons are receiving complementary cross-sectional areas and configurations to closely seal in the chambers 706 and to reciprocate therein.

Control bodies, for example, those like 610 of FIGS. 7 and 8, may have in respective beds 690 seal bodies 691 for the reduction or prevention of leakage from the high-pressure to the low-pressure side of the control body 610 over a respective control arch 631 thereof.

When the chambers 6 are cylinders and have narrowed rotor passages, which are shown in others of the Figures, but not in FIG. 7, the axial extent of the thrust members 616,617 of FIGS. 7 and 8 can become shortened to the dotted lines 702 in FIG. 7. The fluid pressure pockets 622 and the thereto leading arrangements 628,629,626,627 can then be spared and be eliminated from the embodiment of the Figures. By such axial shortening of thrust bodies 616 and 617 and the elimination of the balancing pockets 622,623, a less expensive arrangement is obtained. The "outcuts" are depressions or recesses.

What is claimed, is:

1. In a radial piston device, in combination; a housing, a rotor rotatably mounted in said housing, at least a pair of working chambers which are substantially parallel to each other and laterally distanced from the axis of the said rotor, with said chambers provided in said rotor, at least a pair of pistons reciprocable in said working chambers and along wall faces of said working chambers, inlet channels and oulet channels communicated to said chambers and to said housing, a stroke guide provided in said housing and radially of said chambers and pistons for the guidance of the strokes of said pistons, stroke transfer bodies mounted between said pistons and said stroke guide, control means for the control of flow of fluid to and from said working chambers, and multiple inward and outward guide faces on said stroke guide to guide said reciprocable pistons a plurality of times inward and outward in said chambers along said wall faces at each revolution when said rotor revolves, radial extensions on said rotor extending radially outwards from said chambers to provide extended guide lengths for the guidance of said pistons, fluid pressure pockets provided in the direction of the lateral loads of said pistons with said fluid pressure pockets located between peripheral outer portions of said pistons and said wall faces, control portions provided to said pistons to control the flow of fluid into sid pockets with said control portions acting in timed relation to the move of said transfer bodies along said outward and inward guide faces of said stroke guide, said stroke guide including a medial portion and end portions on the axial ends of said medial portion with said guide faces provided on said end portions, wherein said medial portion provides a recess which extends beyond said guide faces radially into said stroke guide, wherein said radial extensions of said rotor at least temporarily extend into said recess in said stroke guide, wherein said transfer bodies have medial parts and end parts on the axial ends of said medial portion, wherein said medial parts include power transfer centers, wherein said power transfer centers are located in said pistons and at the major portions of the strokes of said pistons between said radial extensions of said rotor, wherein said end parts of said transfer bodies carry bearing portions to engage said guide faces and to guide said transfer bodies and said pistons substantially parallel to said outward and inward guide faces of said stroke guide, wherein said stroke transfer bodies carry on said end parts and axially endwards of said pistons peripherally distanced roller pairs, which form said bearing portions, whereon said medial parts of said transfer bodies are pivotably borne in bearing beds of said pistons, wherein said roller pairs roll along said guide faces, whereby said transfer bodies pivot in said beds when the axes of said roller pairs move substantially parallel along said guide faces, and, wherein said roller pairs form by each of said pairs a peripherally forwardly located and a peripherially rearwardly located roller for the maintenance of stable guidance of said transfer bodies along said guide faces.

2. The device of claim 1 wherein said stroke transfer extend axially in both directions beyond said pistons, to form stroke transfer ends, wherein said ends form pairs of said bearing portions, while said bearing portions of each pair form one forwardly located bearing portion and one rearwardly located bearing portion, and each of said bearing portions carries a rolling member, whereby four rolling members associated to each respective piston and transfer body are rolling along pairs of inward and outward guide faces of said stroke guide in order to define by said rolling under the influence of the configuration of said guide faces of said stroke guide the inclination of pivotion of said transfer bodies and thereby provide and control said flow of fluid into said pockets and said action in said timed relation of said control portions.

* * * * *